US011406145B2

(12) United States Patent
Gambon

(10) Patent No.: US 11,406,145 B2
(45) Date of Patent: Aug. 9, 2022

(54) REAR ACCESS LABOR, DELIVERY, AND POSTPARTUM GOWN WITH SECURITY BONDING PANEL

(71) Applicant: Angel Wraps Baby LLC, Lakewood, OH (US)

(72) Inventor: Lisa Gambon, Cleveland, OH (US)

(73) Assignee: Angel Wraps Baby, LLC, Lakewood, OH (US)

( * ) Notice: Subject to any disclaimer, the term of this patent is extended or adjusted under 35 U.S.C. 154(b) by 102 days.

(21) Appl. No.: 17/098,926

(22) Filed: Nov. 16, 2020

(65) Prior Publication Data

US 2021/0145091 A1 May 20, 2021

Related U.S. Application Data

(60) Provisional application No. 62/936,365, filed on Nov. 15, 2019.

(51) Int. Cl.
*A41D 13/12* (2006.01)
*A41D 1/21* (2018.01)

(52) U.S. Cl.
CPC ..... *A41D 13/1236* (2013.01); *A41D 1/21* (2018.01); *A41D 13/129* (2013.01); (Continued)

(58) Field of Classification Search
CPC . A41D 1/21; A41D 1/215; A41D 1/22; A41D 13/1236; A41D 13/1245; A41D 13/1263; A41D 13/1272; A41D 13/129; A41D 13/12; A41D 13/1254; A41D 2400/482; A41D 2300/30; A41D 2300/324; A41D 2300/32; A41D 1/18; A41D 15/00; (Continued)

(56) References Cited

U.S. PATENT DOCUMENTS 2,707,282 A * 5/1955 Paterson ..... A41D 13/1236 2/221
4,578,825 A * 4/1986 Vote ..... A41D 13/1236 2/114

(Continued)

FOREIGN PATENT DOCUMENTS

WO 2013124554 A2 8/2013

OTHER PUBLICATIONS

Boba Inc. (USA), Boba Wrap Baby Carrier, Grey—Original Stretchy Infant Sling, Perfect for Newborn Babies and Children up to 35 lbs., eCommerce Website [online], [retrieved on Oct. 15, 2020]. Retrieved from the Internet:< URL: https://www.amazon.com/Boba-Baby-Wrap-Carrier-Grey/dp/B005SP2LWW >.

(Continued)

*Primary Examiner* — Amy Vanatta

(57) ABSTRACT

A garment is provided having a closed front portion made of a pair of overlapping fabric panels that are joined along a seam. The garment also includes a lower front access portion where the pair of fabric panels overlap but are not joined and may therefore be parted, providing access to a portion of the wearer's body. A third fabric panel is joined to the overlapping pair fabric panels and is disposed in a chest area of the garment. A rear portion of the garment is openable to provide access to the wearer's spine.

11 Claims, 7 Drawing Sheets

(52) U.S. Cl.
CPC ..... *A41D 13/1245* (2013.01); *A41D 13/1254* (2013.01); *A41D 2300/30* (2013.01)

(58) Field of Classification Search
CPC ..... A41D 10/00; A41B 9/06; A41B 13/06; A47D 13/02; A47D 13/025
USPC ..... 2/74, 83, 104, 105, 114
See application file for complete search history.

(56) References Cited

U.S. PATENT DOCUMENTS

| | | | | |
|---|---|---|---|---|
| 5,444,872 | A * | 8/1995 | Johnson | A41D 13/1209 2/243.1 |
| 5,946,725 | A | 9/1999 | Shatzkin et al. | |
| 6,134,715 | A * | 10/2000 | McLennan | A41D 13/1245 2/105 |
| D691,791 | S * | 10/2013 | Rondone | A41D 13/1209 D3/213 |
| 8,973,793 | B2 | 3/2015 | Arvan | |
| 9,402,430 | B2 | 8/2016 | Jensen et al. | |
| 10,010,193 | B2 | 7/2018 | Simmer et al. | |
| 10,405,672 | B2 | 9/2019 | Chiesa et al. | |
| 10,477,904 | B2 | 11/2019 | Zodel et al. | |
| 10,631,582 | B2 | 4/2020 | Brault | |
| 2007/0271675 | A1* | 11/2007 | Eraca | A41D 1/215 2/104 |
| 2009/0199318 | A1* | 8/2009 | Hamilton | A41D 1/215 2/114 |
| 2010/0313330 | A1* | 12/2010 | Sampson-Howlett | A41D 13/1245 2/243.1 |
| 2011/0016606 | A1* | 1/2011 | Bothwell | A41D 13/1245 2/114 |
| 2011/0108594 | A1 | 5/2011 | Davis | |
| 2011/0231981 | A1* | 9/2011 | Appel | A41D 13/1245 2/114 |
| 2012/0042435 | A1* | 2/2012 | Lintel | A41D 13/129 2/114 |
| 2013/0200116 | A1* | 8/2013 | Arvan | A47D 13/02 224/158 |
| 2014/0284362 | A1 | 9/2014 | Halverstadt et al. | |
| 2016/0206011 | A1* | 7/2016 | Houston | A47D 13/025 |

OTHER PUBLICATIONS

Ergobaby, Baby Wrap Carriers. eCommerce Website [online], [retrieved on Oct. 15, 2020]. Retrieved from the Internet:< URL: https://ergobaby.com/baby-carrier/baby-wrap >.

Hilary Braaksma, Skin-to-Skin Tops to Help New Parents Bond with Baby. Parenting [online], [retrieved on Oct. 15, 2020]. Retrieved from the Internet:< URL: https://www.parenting.com/pregnancy/skin-to-skin-tops-to-help-new-parents-bond-with-baby/ >.

* cited by examiner

REAR ACCESS LABOR, DELIVERY, AND POSTPARTUM GOWN WITH SECURITY BONDING PANEL

This application claims the benefit of U.S. provisional patent application No. 62/936,365 filed Nov. 15, 2019, which is incorporated herein by reference in its entirety.

I. BACKGROUND OF THE INVENTION

A. Field of Invention

The invention relates to the field of labor, delivery, and postpartum garments.

B. Description of the Related Art

Labor and delivery presents unique garment problems for mothers and medical personnel. In preparation for delivery, it is often necessary for medical professionals to access portions of the mother's body to, for example, administer epidural drugs, provide medical care, and perform routine examination before and after delivery. Following delivery, it is known to have mothers bond with their baby by placing mother and child in skin-to-skin contact. Various garments are known to address one or more of these problems; however, all have certain shortcomings. For instance, a postpartum garment is known for providing skin-to-skin contact where the garment opens in the front. This unfortunately, does not address the need to access the mother's spine pre-delivery for administering epidural injections. It is also known to provide wrapping garments that must be wrapped and tied according to specific, and usually overly complex, patterns. This has the obvious disadvantage of making it very easy to improperly wrap and tie the garment, placing the child in danger of being dropped, and also providing no access to the mother's spine without engaging in the cumbersome task of unwrapping and rewrapping the garment. What is needed is a garment that provides access to the mother's spinal column pre-delivery, provides access to the mother's lower torso during delivery, and maintains mother and baby in skin-to-skin contact postpartum.

Some embodiments of the present invention may provide one or more benefits or advantages over the prior art.

II. SUMMARY OF THE INVENTION

Some embodiments may relate to a garment, comprising a pair of fabric panels that overlap in a front of the garment and are joined to close the front of the garment. The garment also comprises a lower front access portion of the closed front of the garment where the pair of fabric panels overlap but are not joined and may therefore be parted, providing access to a portion of the wearer's body. The garment also comprises a third fabric panel joined to the overlapping pair fabric panels and is disposed in a chest area of the garment, wherein the third fabric panel is joined at a lower end to an interior surface of an innermost panel of the pair of fabric panels, and the top of the third fabric panel is not joined to any other part of the garment. The garment also comprises a rear portion of the garment defined by rear edges of the pair of fabric panels extending rearward toward each other and overlapping in the rear of the garment. The garment also comprises the rear edges of the pair of fabric panels each include at least one fastener. The garment also comprises an inside fastener panel joined to the garment at a first lateral side of the garment, wherein the inside fastener panel includes at least one fastener mateable with the at least one fastener of a first one of the rear edges of the pair of fabric panels. And the garment also comprises an outside fastener panel joined to the garment at a second lateral side of the garment, wherein the outside fastener panel includes at least one fastener mateable with the at least one fastener of a second one of the rear edges of the pair of fabric panels.

Other benefits and advantages will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof, wherein like reference numerals indicate like structure, and wherein.

IV. DETAILED DESCRIPTION OF THE INVENTION

As used herein the terms "embodiment", "embodiments", "some embodiments", "other embodiments" and so on are not exclusive of one another. Except where there is an explicit statement to the contrary, all descriptions of the features and elements of the various embodiments disclosed herein may be combined in all operable combinations thereof.

Language used herein to describe process steps may include words such as "then" which suggest an order of operations; however, one skilled in the art will appreciate that the use of such terms is often a matter of convenience and does not necessarily limit the process being described to a particular order of steps.

Conjunctions and combinations of conjunctions (e.g. "and/or") are used herein when reciting elements and characteristics of embodiments; however, unless specifically stated to the contrary or required by context, "and", "or" and "and/or" are interchangeable and do not necessarily require every element of a list or only one element of a list to the exclusion of others.

Terms of degree, terms of approximation, and/or subjective terms may be used herein to describe certain features or elements of the invention. In each case sufficient disclosure is provided to inform the person having ordinary skill in the art in accordance with the written description requirement and the definiteness requirement of 35 U.S.C. 112.

Figure 1:
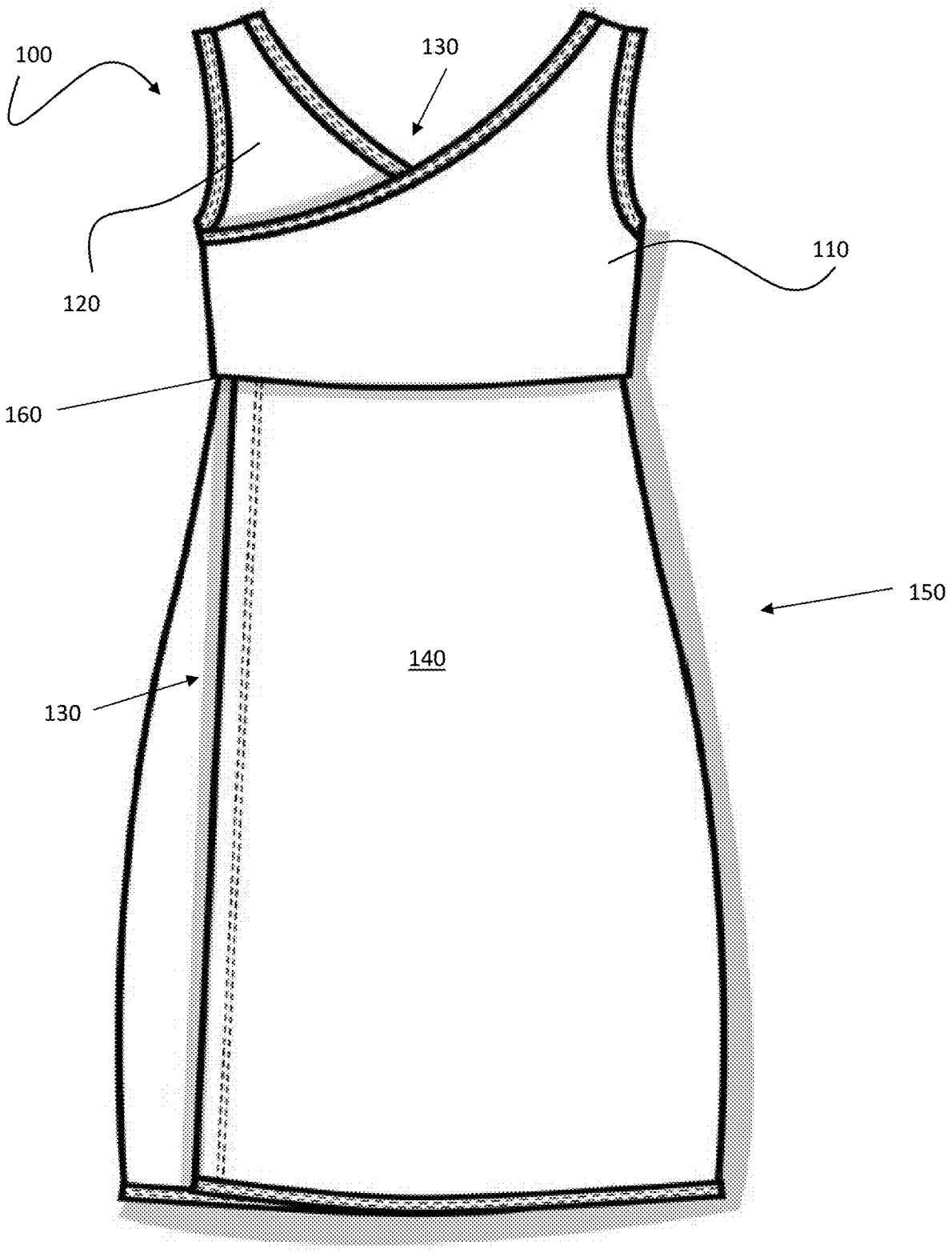
FIG. 1 is a front outside view of a garment according to an embodiment of the invention.

Referring now to the drawings wherein the showings are for purposes of illustrating embodiments of the invention only and not for purposes of limiting the same, FIG. 1 is a front view of a garment according to one embodiment 100 of the invention. The garment includes a pair of fabric panels 110, 120 that overlap 130 in the front 140 of the garment 100. The overlapping panels 110, 120 are joined to form a closed front of the garment. As used herein, the term joined means a sewn, bonded, or welded seam. The seam where the overlapping panels 110, 120 are joined is not shown in FIG. 1. The pair of fabric panels 110, 120 further define armholes 170, and shoulder straps 180.

The garment includes a lower front access portion 150 formed by the overlapping fabric panels 110, 120 which are not joined below a point 160, and may therefore be parted, providing access to a portion of the wearer's body. This feature may be particularly useful before delivery while the mother is being examined or drugs are being administered, e.g. to the thigh or pelvic area. The overlapping fabric panels 110, 120 may each comprise a unitary fabric panel or may comprise a composite of a plurality of component panels joined together.

Figure 2:
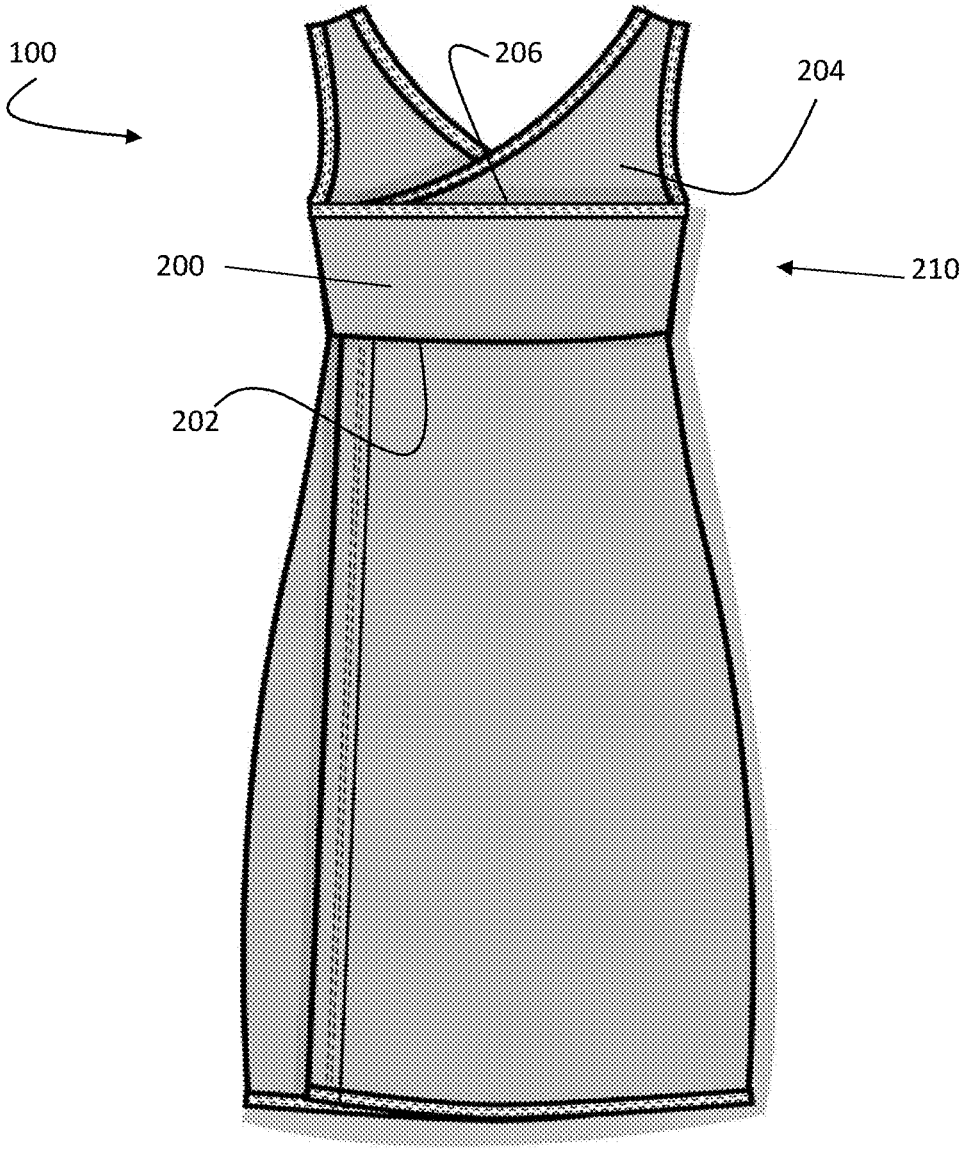
FIG. 2 is a front inside view of the garment of FIG. 1.

FIG. 2 is an inside view of the front of the garment shown in FIG. 1. A third panel 200 is shown. The third fabric panel 200 is joined or fastened to the overlapping pair of fabric panels 110, 120 at a first lateral side 230*f* and a second lateral side 230*s*. The third fabric panel 200 is disposed in a chest area 210 of the garment 100 and is joined or fastened at a lower end 202 to an interior surface 204 of an innermost panel of the pair of fabric panels 110, 120. The top 206 of the third fabric panel 200 is not joined to any other part of the garment 100. The child may be placed in skin-to-skin contact between the third fabric panel 200 and the mother's chest. Alternatively, a portion of the child's body may be placed between the third fabric panel 200 and the overlapping pair of fabric panels 110, 120 while the rest of the child's body is in skin-to-skin contact with the mother's chest. For example, and without limitation, the child's feet and backside may be between the third fabric panel 200 and the pair of fabric panels 110, 120 while the mother is in a reclined position or lying down, e.g. in a hospital bed.

Figure 3:
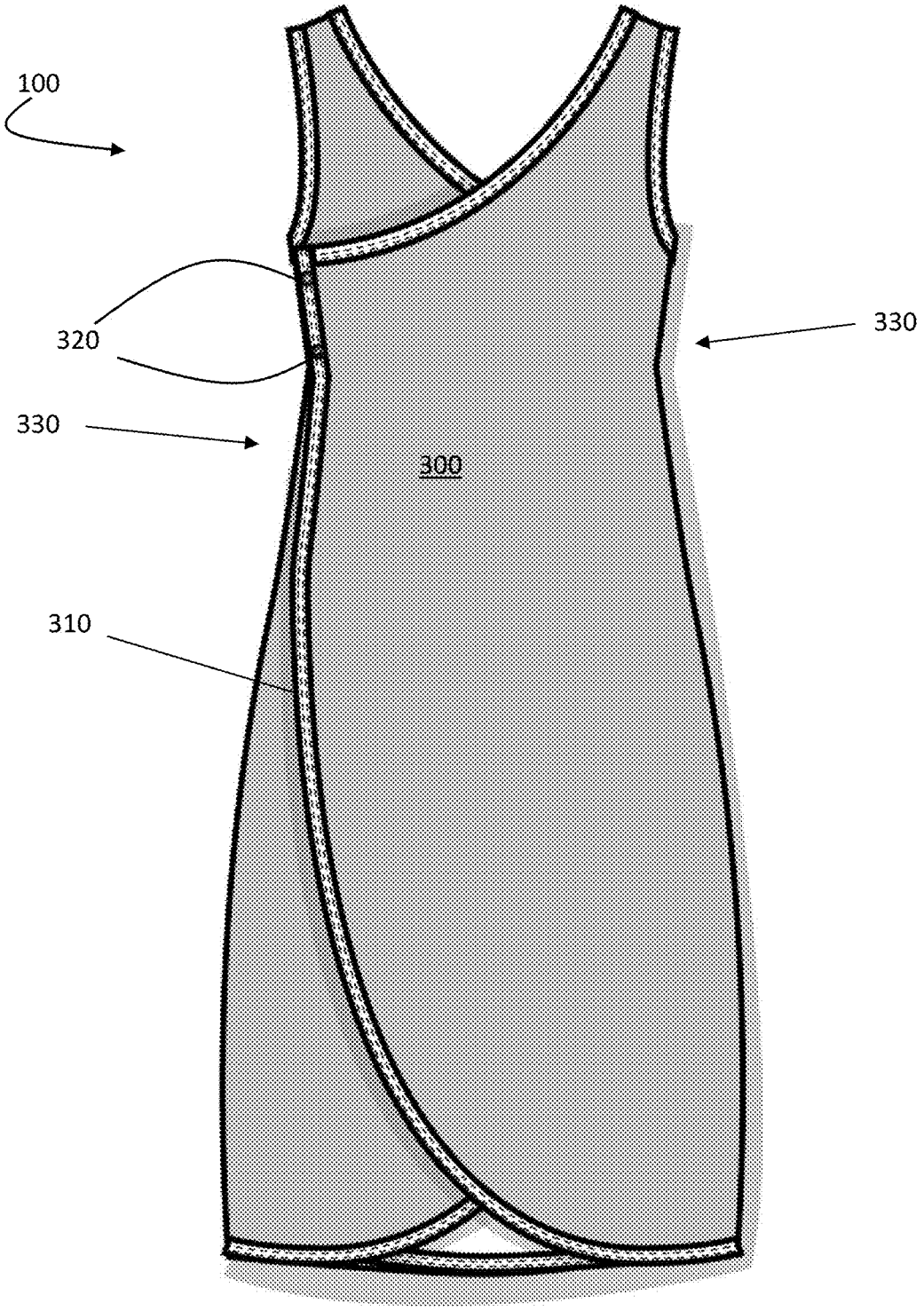
FIG. 3 is a rear inside view of the garment of FIG. 1.
Figure 4:
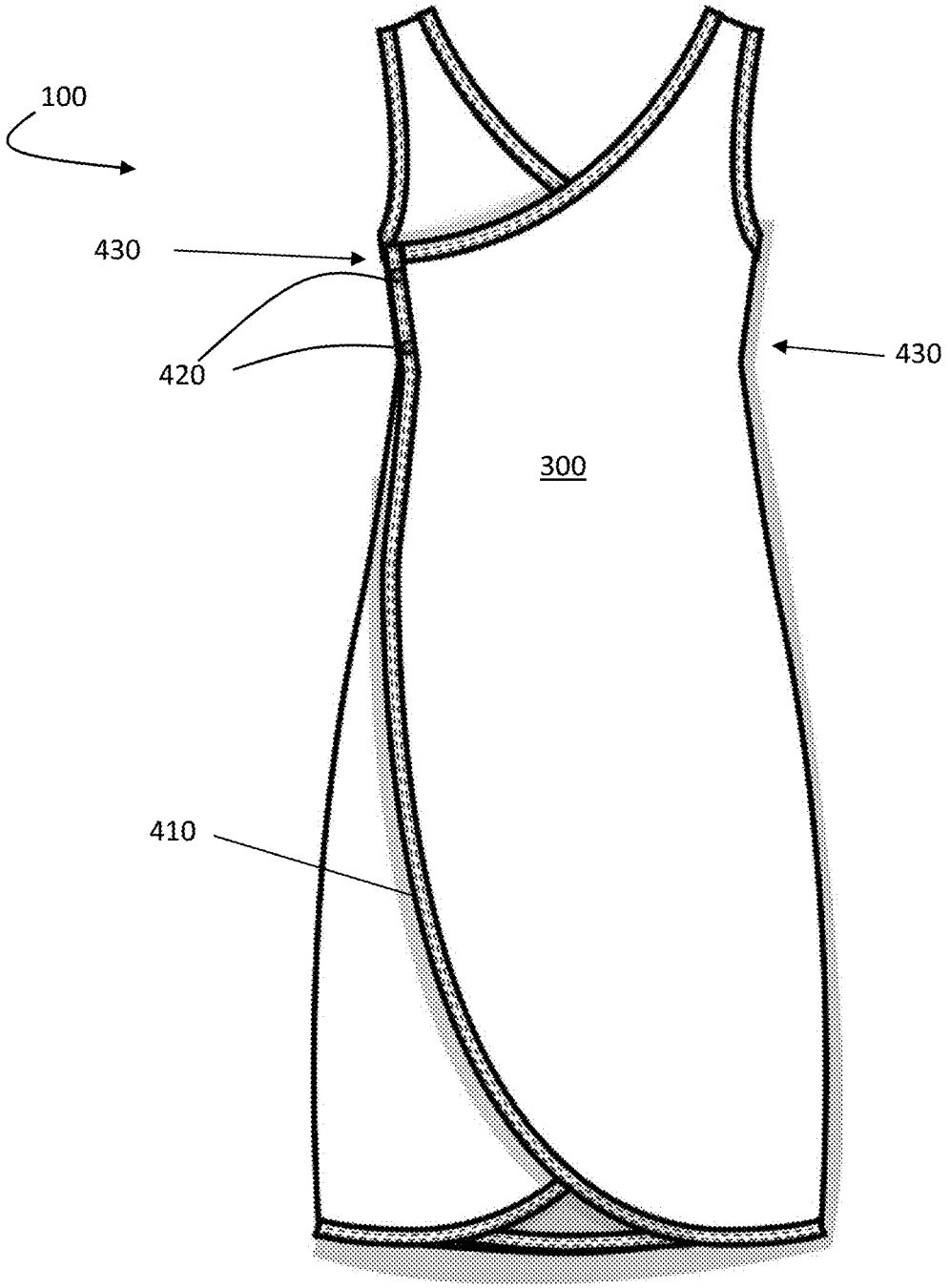
FIG. 4 is a rear outside view of the garment of FIG. 1.

FIGS. 3 and 4 illustrate the rear portion 300 of the embodiment shown in FIG. 1. FIG. 3 shows the garment rear 300 from the inside of the garment 100 where a pair of inside fasteners 320 are visible at a lateral side of the garment 100. Similarly, FIG. 4 shows the garment rear 300 from the outside. A pair of outside fasteners 420 are visible in FIG. 4. The rear portion 300 of the garment 100 is defined by rear edges 310, 410 of the pair of fabric panels 110, 120 extending rearward toward each other and overlapping in the rear 300 of the garment 100. The rear edges 310, 410 of the pair of fabric panels 110, 120 each include at least one fastener. The illustrated embodiment includes a pair of inside fasteners 320 and a pair of outside fasteners 420 cooperating with a mating fastener (out of view) disposed on the lateral edges 330, 430 of the garment 100.

Figure 5:
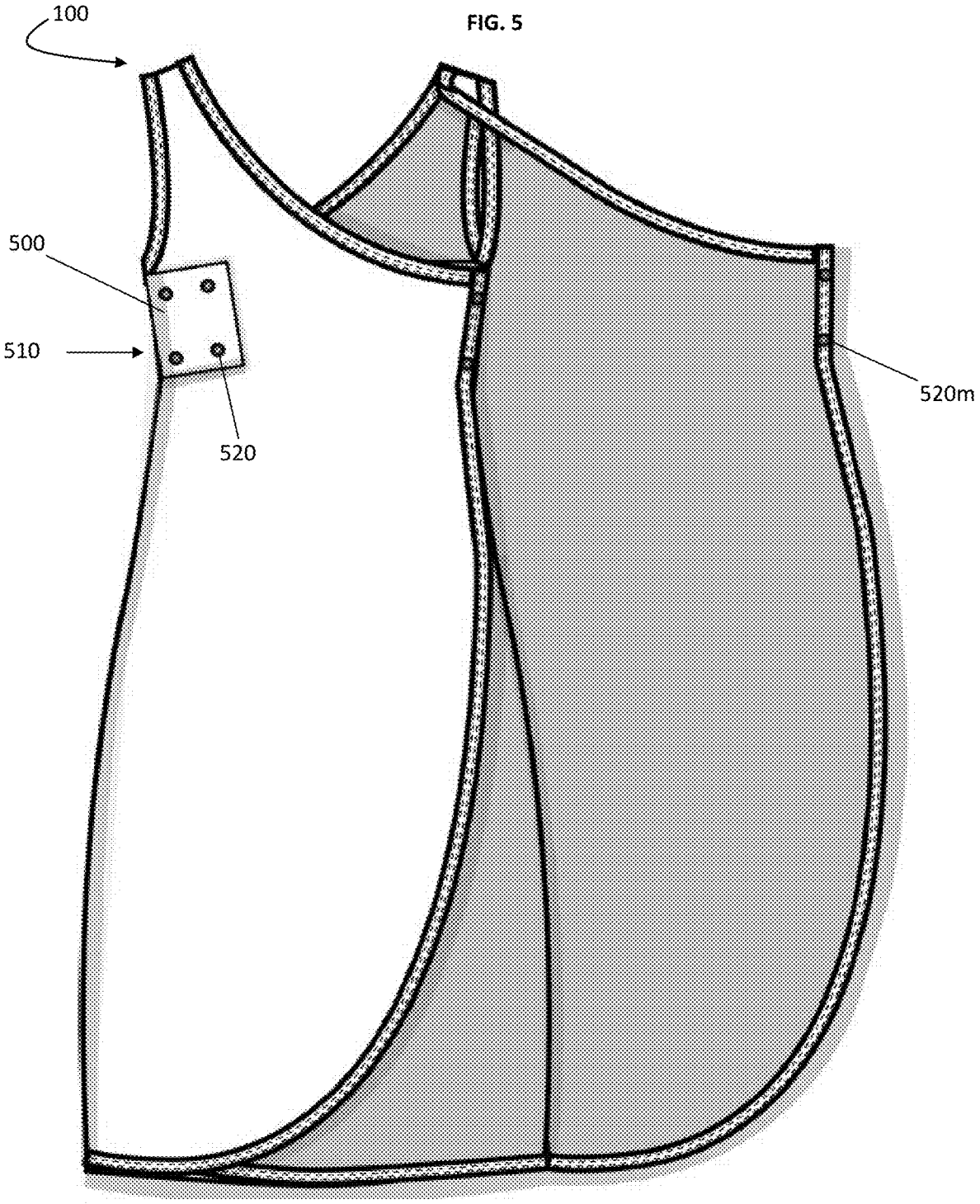
FIG. 5 is a rear view of the garment of FIG. 1 with the rear partially open.

Turning to FIG. 5, a rear view of the garment 100 is shown partially open to reveal the fastener panels. An outside fastener panel 500 joined to the garment 100 at a first lateral side 510 of the garment. The outside fastener panel 500 includes at least one fastener 520. The illustrated embodiment includes four fasteners 520 arranged in two vertical columns which are mateable with corresponding fasteners 520*m* of a rear edge of an opposing fabric panel. More specifically, the wearer may select which of the two columns of fasteners 520 to mate with the opposing fasteners 520*m*, thereby adjusting the fit of the garment. The fastener panel 500 may optionally be fabricated from an elastic material such as a Spandex® to allow for further adjustment to the wearer's body.

Figure 6:
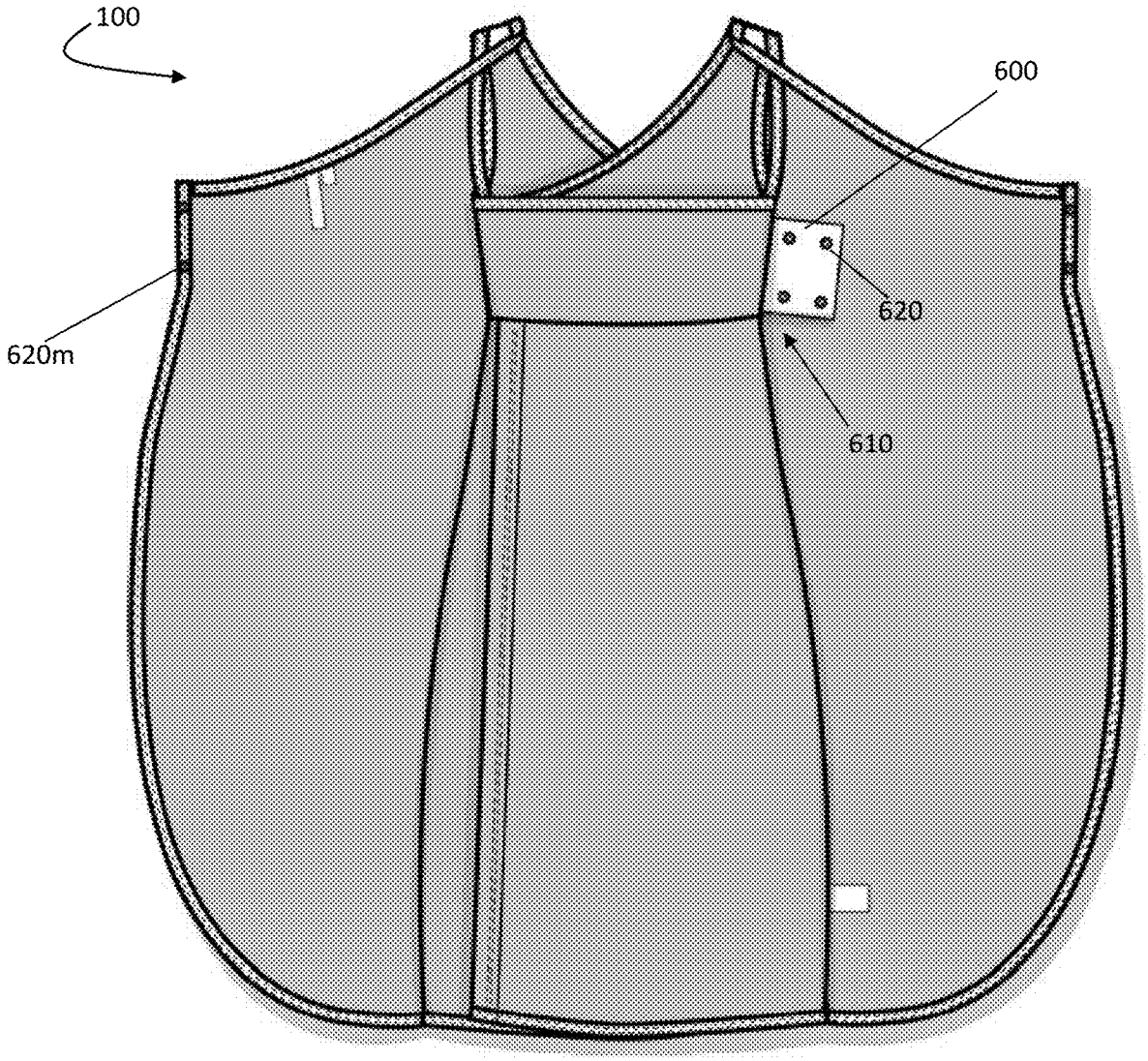
FIG. 6 is a rear view of the garment of FIG. 1 with the rear fully open.

FIG. 6 is also a rear view of the garment 100, but the garment is shown fully opened, exposing the inside of the garment. An inside fastener panel 600 joined to the garment 100 at a first lateral side 610 of the garment. The inside fastener panel 600 includes at least one fastener 620. The illustrated embodiment includes four fasteners 620 arranged in two vertical columns which are mateable with corresponding fasteners 620*m* of a rear edge of an opposing fabric panel. More specifically, the wearer may select which of the two columns of fasteners 620 to mate with the opposing fasteners 620*m*, thereby adjusting the fit of the garment. The fastener panel 600 may optionally be fabricated from an elastic material such as a Spandex® to allow for further adjustment to the wearer's body.

Figure 7:
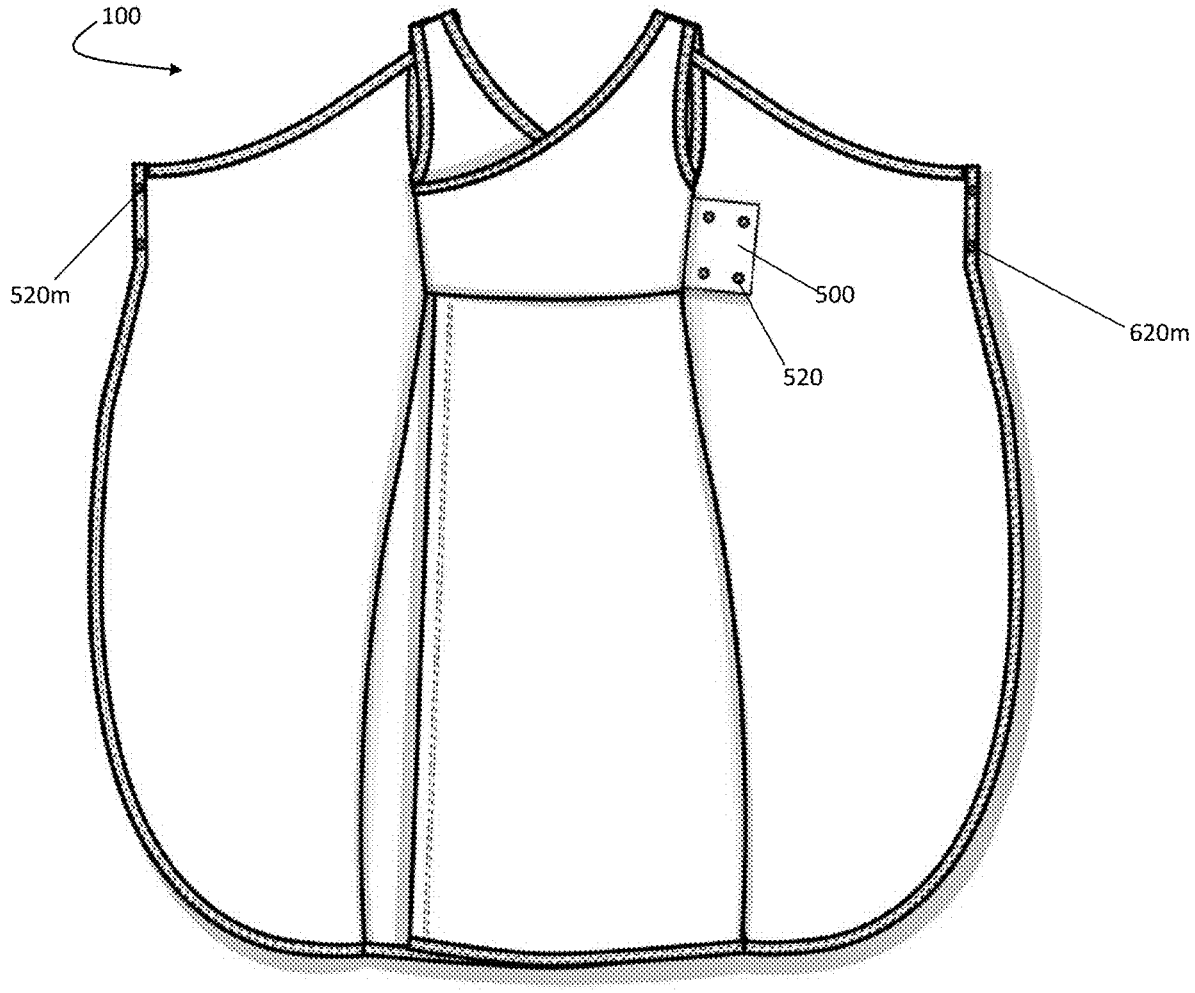
FIG. 7 is a front outside view of the garment of FIG. 1 with the rear fully open.

FIG. 7 is a front view of the garment 100 with the back fully open. The outside fastener panel 500 is visible as well as the fasteners 520 and the opposing fasteners 520*m*. Also visible are the opposing fasteners 620*m* that cooperate with the inside fastener panel 600 which is out of view.

It will be apparent to those skilled in the art that the above methods and apparatuses may be changed or modified without departing from the general scope of the invention. The invention is intended to include all such modifications and alterations insofar as they come within the scope of the appended claims or the equivalents thereof.

The following list shows the correlation between the various reference numerals used in the appended drawings, and the elements of the drawings that they represent. This list is provided only for convenience and is not intended to be limiting in any way. Abbreviated, shortened, or otherwise somewhat different wording may be used herein to describe the same structures or drawing elements without obscuring their meaning to the person having ordinary skill in the art.

I claim:

1. A garment, comprising:

a pair of fabric panels that overlap in a front of the garment and are joined to close the front of the garment;

a lower front access portion of the closed front of the garment where the pair of fabric panels overlap but are not joined and may therefore be parted, providing access to a portion of the wearer's body;

a third fabric panel joined to the overlapping pair of fabric panels and is disposed in a chest area of the garment, wherein the third fabric panel is joined at a lower end to an interior surface of an innermost panel of the pair of fabric panels, and the top of the third fabric panel is not joined to any other part of the garment;

a rear portion of the garment defined by rear edges of the pair of fabric panels extending rearward toward each other and overlapping in the rear of the garment;

the rear edges of the pair of fabric panels each include at least one fastener;

an inside fastener panel joined to the garment at a first lateral side of the garment, wherein the inside fastener panel includes at least one fastener mateable with the at least one fastener of a first one of the rear edges of the pair of fabric panels; and an outside fastener panel joined to the garment at a second lateral side of the garment, wherein the outside fastener panel includes at least one fastener mateable with the at least one fastener of a second one of the rear edges of the pair of fabric panels.

2. The garment of claim 1, wherein each of the pair of fabric panels comprises a plurality of component panels joined together.

3. The garment of claim 1, wherein the third fabric panel extends from the first lateral side of the garment to the second lateral side of the garment.

4. The garment of claim 1, wherein the third fabric panel is joined to the first lateral side of the garment and to the second lateral side of the garment.

5. The garment of claim 1, wherein the inside fastener panel comprises a plurality of fasteners arranged to allow for adjusting the garment to a wearer's body size.

6. The garment of claim 5, wherein the inside fastener panel comprises an elastic material elastically responsive to a wearer's body size.

7. The garment of claim 1, wherein the outside fastener panel comprises a plurality of fasteners arranged to allow for adjusting the garment to a wearer's body size.

8. The garment of claim 7, wherein the outside fastener panel comprises an elastic material elastically responsive to a wearer's body size.

9. The garment of claim 1, wherein the inside fastener panel is joined to a first lateral edge of the third fabric panel.

10. The garment of claim 1, wherein the outside fastener panel is joined to a second lateral edge of the third fabric panel.

11. The garment of claim 1, wherein the pair of fabric panels define armholes and shoulder straps.

* * * * *